US006511110B2

(12) United States Patent
Roye

(10) Patent No.: US 6,511,110 B2
(45) Date of Patent: Jan. 28, 2003

(54) REFUSE COLLECTING TOOL

(76) Inventor: Samuel L. Roye, 404 El Salto Dr., Capitola, CA (US) 95010

( * ) Notice: Subject to any disclaimer, the term of this patent is extended or adjusted under 35 U.S.C. 154(b) by 0 days.

(21) Appl. No.: 09/927,137

(22) Filed: Aug. 10, 2001

(65) Prior Publication Data

US 2002/0021012 A1 Feb. 21, 2002

Related U.S. Application Data

(60) Provisional application No. 60/224,825, filed on Aug. 11, 2000.

(51) Int. Cl.[7] ..... B65B 67/12

(52) U.S. Cl. ..... 294/1.1; 248/99

(58) Field of Search ..... 294/1.1, 1.3, 1.4, 294/55; 15/257.1, 257.4, 257.7, 257.8; 441/108, 390, 391; 248/95, 97, 99, 101; 383/33, 34

(56) References Cited

U.S. PATENT DOCUMENTS

| | | | | | |
|---|---|---|---|---|---|
| 4,012,067 | A | | 3/1977 | Travis | 294/1.4 |
| 4,279,437 | A | | 7/1981 | Goldbarg | 294/1.4 |
| 4,548,372 | A | * | 10/1985 | Lutzker | 294/1.1 X |
| 4,889,300 | A | * | 12/1989 | Gibson et al. | 248/97 |
| 5,222,536 | A | * | 6/1993 | Hodgdon et al. | 248/99 X |
| 5,308,027 | A | * | 5/1994 | Fullilove | 248/99 X |
| 5,325,565 | A | | 7/1994 | Suzuki | 15/257.4 |
| 5,413,394 | A | * | 5/1995 | Mitchell | 294/1.1 |
| 5,564,267 | A | | 10/1996 | Bricker et al. | 56/400.12 |
| 5,594,975 | A | | 1/1997 | Christen | 16/114 |
| 5,603,584 | A | | 2/1997 | Schuele | 403/371 |
| 5,642,911 | A | | 7/1997 | Gatch | 294/61 |
| 5,655,739 | A | | 8/1997 | Goo | 248/101 |
| 5,718,400 | A | * | 2/1998 | Dwy | 294/1.1 X |
| 5,738,315 | A | | 4/1998 | Kent, Jr. | 248/97 |
| 5,899,419 | A | | 5/1999 | Ross et al. | 248/97 |
| 6,019,405 | A | | 2/2000 | Tsou | 294/1.4 |
| 6,076,782 | A | * | 6/2000 | Alderman | 248/97 |
| 6,199,802 | B1 | * | 3/2001 | Scheibe | 248/97 |

* cited by examiner

*Primary Examiner*—Johnny D. Cherry
(74) *Attorney, Agent, or Firm*—Larry B. Guernsey; Intellectual Property Law Offices

(57) ABSTRACT

A collecting tool (10) for use with a refuse collection bag (29), including a frame (12) having a number of frame members (13) which are joined by connectors (17). A number of retainers (31) attach a refuse collection bag (29) to the frame (12). A handle (30) is detachably attachable to the frame (12), so that the frame (12) and the attached bag (29) can be manipulated to position the collecting tool (10) during refuse collection. A number of legs (28) are detachably attachable to the frame (12), the legs (28) acting to support the frame (12) and an attached refuse collection bag (29) in an upright position (52). One of the legs (28) may optionally serve as the handle (30) or may help support the frame in a free-standing position (58). Optionally, one of the retainers (17) is a snap ramp (34), including a flat ramp portion (36) which is reversible in direction so that the flat ramp portion (36) may serve as an inwardly disposed entrance ramp (54), or as an outwardly disposed entrance ramp (56).

21 Claims, 9 Drawing Sheets

REFUSE COLLECTING TOOL

This application claims priority from U.S. Provisional Application Serial No. 60/224,825, filed Aug. 11, 2000, which has the same inventors as the present application.

TECHNICAL FIELD

The present invention relates generally to tools used in refuse collection, and more particularly to implements for collecting leaf matter or other debris into bags.

BACKGROUND ART

Collection of refuse has always been a difficult job, especially when there are large volumes of materials such as leaves, wood shavings, dirt or hair clippings to be dealt with. Once refuse is collected in one place, there is still the difficulty of placing it in bags or other receptacles for disposal. The traditional solution has been to use a dustpan which is placed on the ground, usually while the user stoops in place to hold it with one hand and attempts to manipulate a broom with his other hand. This is of course a very awkward position and one which can be hard on the human body from an ergonomic standpoint.

A more recent solution has been to attach a receptacle to a handle or stick, in the manner of lobby dustpans. This type generally has a metal box, open on one side, which has a hinged handle mounted to it. The box rests on the ground with the open side available for sweeping materials into. This receptacle must still be emptied periodically into a trash bin or garbage bags, which can cause stirring of dust during the transfer. This can be harmful to people with allergies or who prefer to maintain the cleanliness of their clothing. In addition, the volume of lobby dustpans is generally small, and the receptacle is usually of a specific size and not detachable or replaceable.

Another solution is to include some form of bag supporting member in a tool which keeps the mouth of the bag opened to receive materials. U.S. Pat. No. 4,012,067 to Travis, U.S. Pat. No. 6,019,405 to Tsou, U.S. Pat. No. 4,279,437 to Goldbarg and U.S. Pat. No. 5,655,739 to Tea-Wah Goo all disclose various tools having bags attached to frames which can be used to collect refuse.

There are several difficulties with this type of device. Many of these mechanisms are complex and prone to breakage or malfunction. Also, once the refuse bag is filled, the user must usually bend over, or squat in place to manipulate the bag and its contents, such as tying the bag closed, replacing the bag, etc. These operations may be exhausting in themselves, and may be especially undesirable to persons with lower back trouble, knee or joint problems, or those who tire easily. It would be very desirable that a collection tool could convert from a manipulation position to an upright, self supporting position which would not require its user to bend over to manipulate the refuse bag and its contents.

Thus there is a great need for a refuse collecting tool which can be converted to an upright position, wherein a detachable bag can be processed or manipulated, which can collapse to a compact configuration for storage, and which is light-weight and easily manipulated.

DISCLOSURE OF INVENTION

One object of the present invention is to present a refuse collecting tool which uses detachable, preferably standard garbage bags.

Another object of the present invention is to present a refuse collecting tool which can be converted to an upright position, so that a detachable bag can be processed or manipulated.

Yet another object of the present invention is to present a refuse collecting tool which can collapse to a compact configuration for storage.

A further object of the present invention is to present a refuse collecting tool which is light-weight and easily manipulated.

Briefly, one preferred embodiment of the present invention is a collecting tool for use with a refuse collection bag, including a frame having a number of frame members which are joined by connectors. A number of retainers attach a refuse collection bag to the frame. A handle is detachably attachable to the frame, so that the frame and the attached bag can be manipulated to position the collecting tool during refuse collection. A number of legs are detachably attachable to the frame, the legs acting to support the frame and an attached refuse collection bag in an upright position. One of the legs may optionally serve as the handle.

Optionally, one of the retainers is a snap ramp, including a flat ramp portion which is reversible in direction so that the flat ramp portion may serve as an inwardly disposed entrance ramp, or as an outwardly disposed entrance ramp.

An advantage of the present invention is that it uses standard garbage bags which are disposable when filled.

Another advantage of the present invention is that it is convertible to a self-supporting upright position by adding detachable legs which convert the frame into a table-like structure.

And another advantage of the present invention is that it collapses or disassembles to form a very compact configuration for storage.

A further advantage of the present invention is that it is very simple in construction.

A yet further advantage is that it is very light weight and easy to manipulate.

An additional advantage is that it includes a reversible snap-on ramp which can be positioned either as an inwardly disposed or outwardly disposed entrance ramp to aid in manipulating refuse materials.

These and other objects and advantages of the present invention will become clear to those skilled in the art in view of the description of the best presently known mode of carrying out the invention and the industrial applicability of the preferred embodiment as described herein and as illustrated in the several figures of the drawings.

BRIEF DESCRIPTION OF THE DRAWINGS

The purposes and advantages of the present invention will be apparent from the following detailed description in conjunction with the appended drawings in which.

BEST MODE FOR CARRYING OUT THE INVENTION

Figure 1:
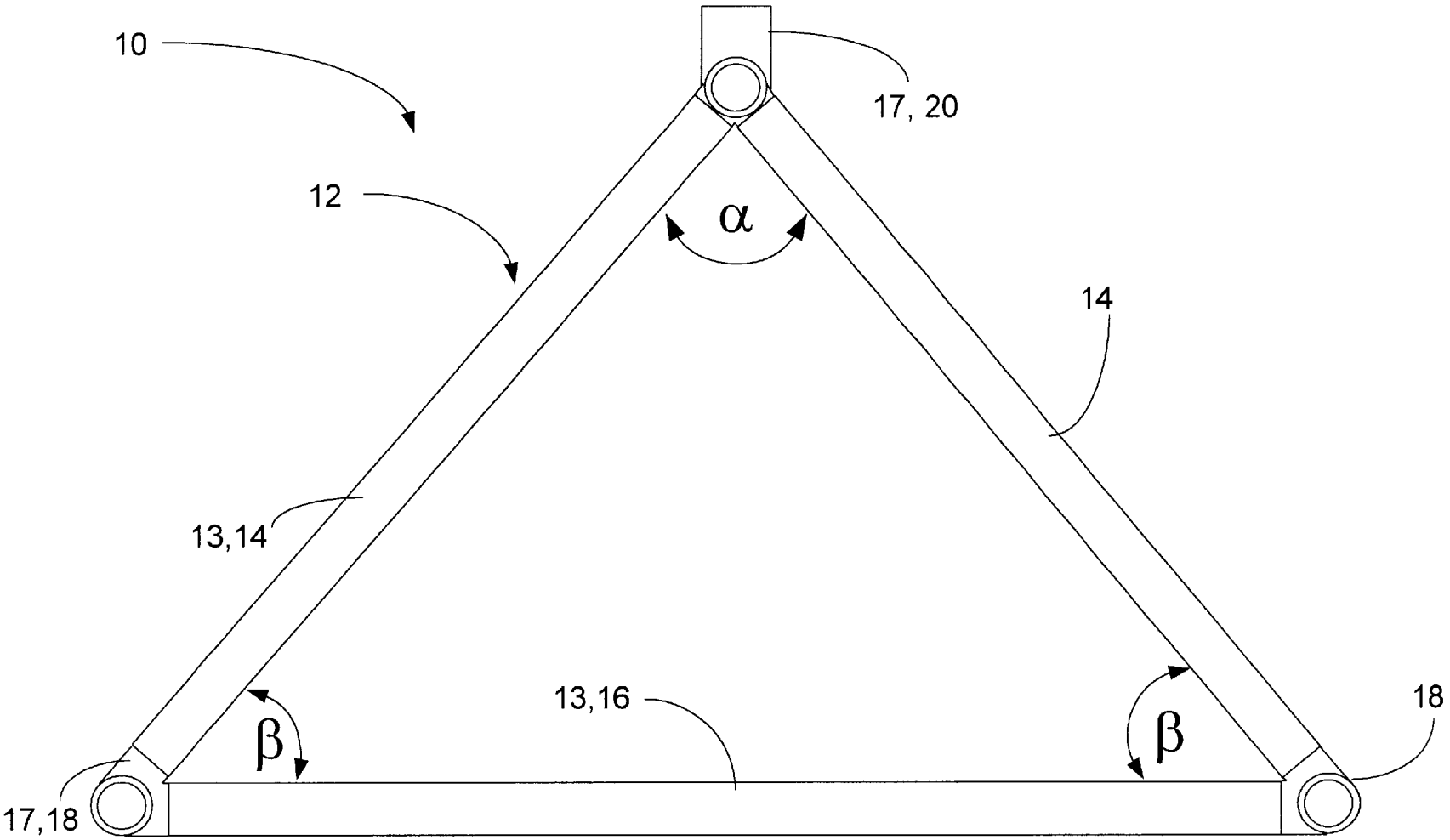
FIG. 1 illustrates a top plan view of the frame of the refuse bag collection tool.

A preferred embodiment of the present invention is a refuse collection tool. As illustrated in the various drawings herein, and particularly in the view of FIG. 1, a form of this preferred embodiment of the inventive device is depicted by the general reference character 10.

The refuse collection tool 10 can be used in four different ways: 1) as a support frame with attached support legs for holding a collection bag; 2) as a collection tool with a handle and an inward disposed entrance ramp for use in raking leaves into a collection bag; 3) as a collection tool with a handle and outwardly disposed entrance ramp for use with a broom for collecting refuse having a smaller particle size, and 4) attaching one leg to a socket in the apex connector to support the frame and the mouth of the bag in a free-standing configuration. Each of these modes of operation will be discussed in turn after a general description of the components.

FIG. 1 illustrates the frame 12 of the refuse bag collection tool 10. The triangular frame 12 of the preferred embodiment includes frame members 13, which in the preferred embodiment includes 2 side members 14 of equal length, and a bottom member 16 of greater length. Connectors 17, which join the frame members 13, include two corner connectors 18 and an apex connector 20. The currently preferred dimensions for the side members 14 are 18¾ inches, and the bottom member is preferably 24 inches, and all are made from ½ inch steel tubing, although other materials such as ¾ inch PVC pipe can alternately be used. The angle $\alpha$ is preferably 80 degrees, and the two angles $\beta$ are equal and 50 degrees. These angles and dimensions are not to be construed as limitations and many other configurations and dimensions are possible. The present invention also contemplates other geometric configurations, for instance, the frame could be a right triangle, an equilateral triangle, a square, a rectangle, a pentagon, a hexagon, an octagon, etc. It will be obvious to one skilled in the art that many variations are possible and all are contemplated by the present invention.

Figure 2:
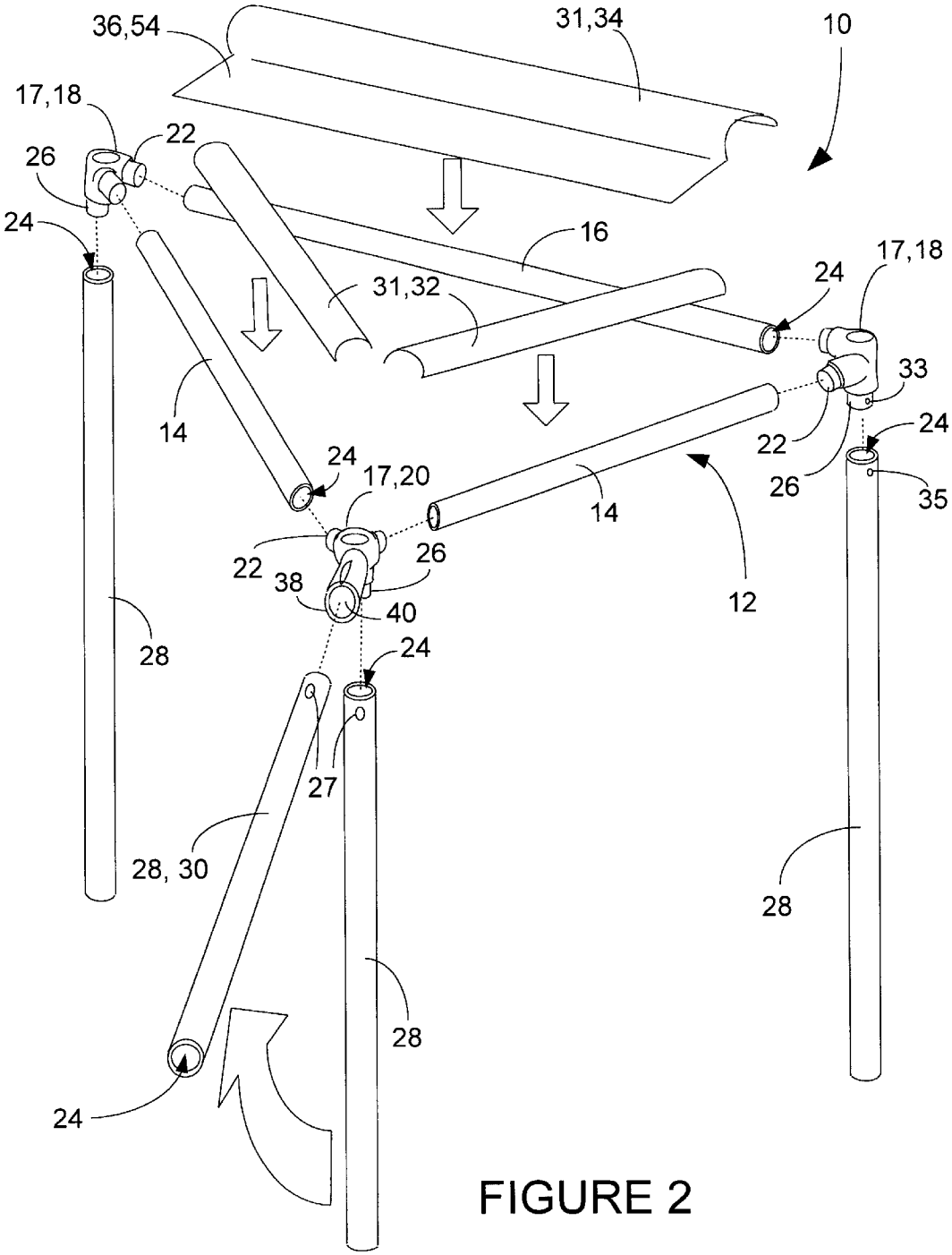
FIG. 2 shows an exploded perspective view of the frame and supports of the present invention.
Figure 3:
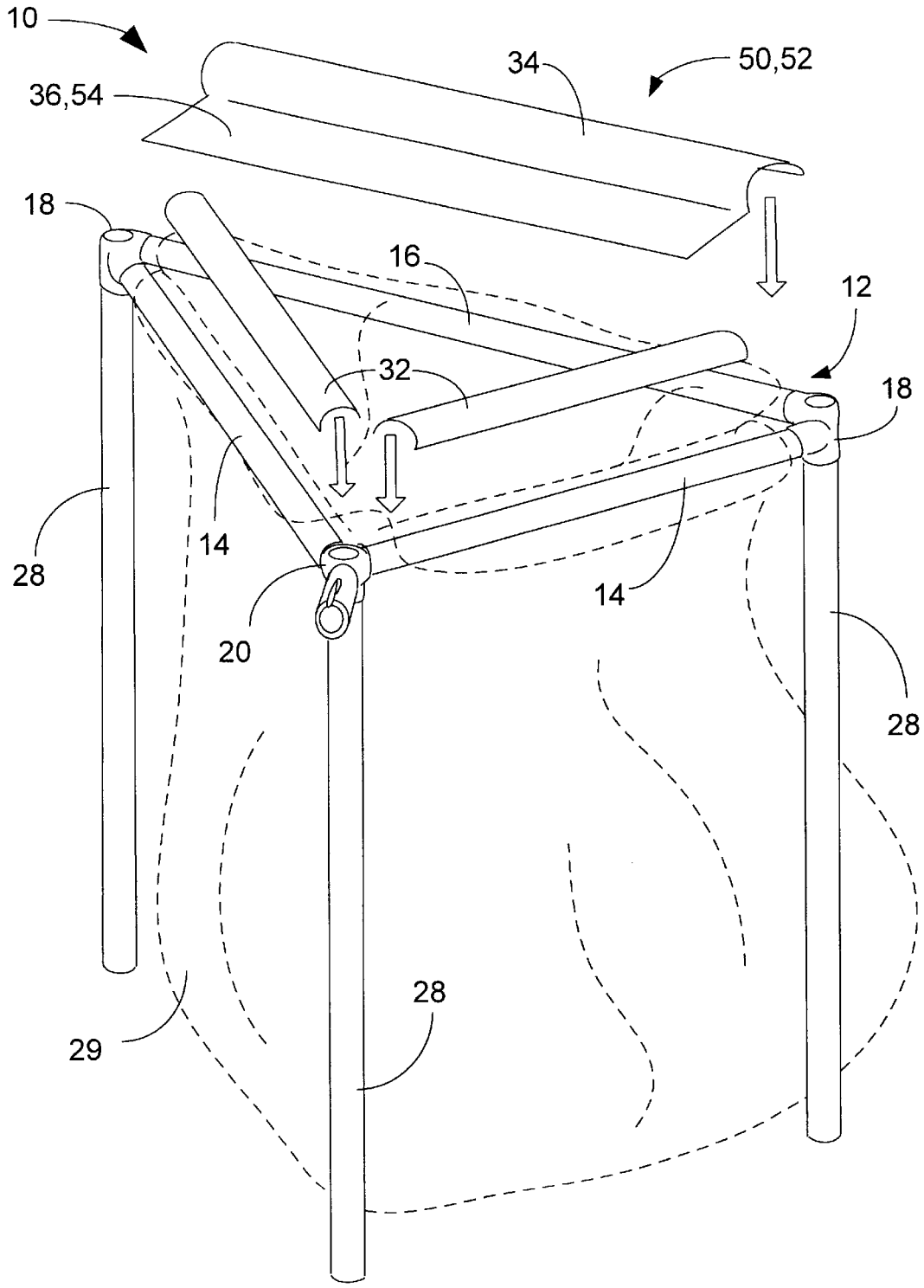
FIG. 3 illustrates a perspective view of the present invention in its support frame configuration with a collection bag shown in dashed lines.

FIG. 2 illustrates an exploded view of the refuse collection tool 10. Side members 14 are shown as hollow tubes which attach to the corner connectors 18 and apex connector 20 by tubular flanges 22 on the connectors 18, 20 which are inserted into the hollow bores 24 of the side members 14 and bottom member 16. The corner connectors 18 and apex connector 20 also each have a lower flange 26, by which legs 28 each also having a hollow bore 24 can be attached to provide support for the frame 12, turning it into a sort of table frame. Referring now also to FIG. 3, a collection bag 29, shown in dashed lines, can then be arranged with the bulk of the bag 29 between the legs 28 with the lip of the bag folded over the side and bottom members 14, 16. To keep the bag in place, retainers 31, such as snap retainers 32 can be placed over the bag lip and pressed into place, to snap onto the side members 14. The snap retainers 32 are preferably tubular sections, which are a bit more than half-rounds, i.e. approximately 190 degrees, etc., of slightly greater inner diameter than the outer diameter of the side members 14. This is preferred, but of course many other retainers for securing the bag to the frame may be used, such as clips, etc. The retainers 31 may also attach to the connectors 17 rather than the frame members 13, although this is not preferred. It will be obvious to one skilled in the art that a single large retainer may be used in place of multiple single retainers, so that for example, the three separate retainers shown in FIG. 2 could be configured as a single triangular piece which would snap on as a unit, and although this is less preferred, this should be considered as an obvious equivalent structure.

The lip of the bag 29 is secured to the bottom member 16 by a snap ramp 34, which is a snap retainer 32 with a flat ramp portion 36 which can be used to channel refuse into the collection bag. The snap ramp 34 attaches in a similar manner to the snap retainers 32 and is reversible in direction so that the ramp portion 36 can be positioned on the inward side of the frame 12 as in FIGS. 2–5, which will be termed an inwardly disposed ramp 54, or positioned on the outward side as in FIG. 7, which will be termed an outwardly disposed ramp 56. When positioned on the inward side, it is helpful in channeling larger debris such as leaves into the bag. When it is outward facing the ramp portion 36 acts as a ramp to direct smaller particles over the width of the bottom member 16 tubing. It is most effective for general sweeping, in a similar manner to the inclined entrance to a dustpan.

Figure 7:
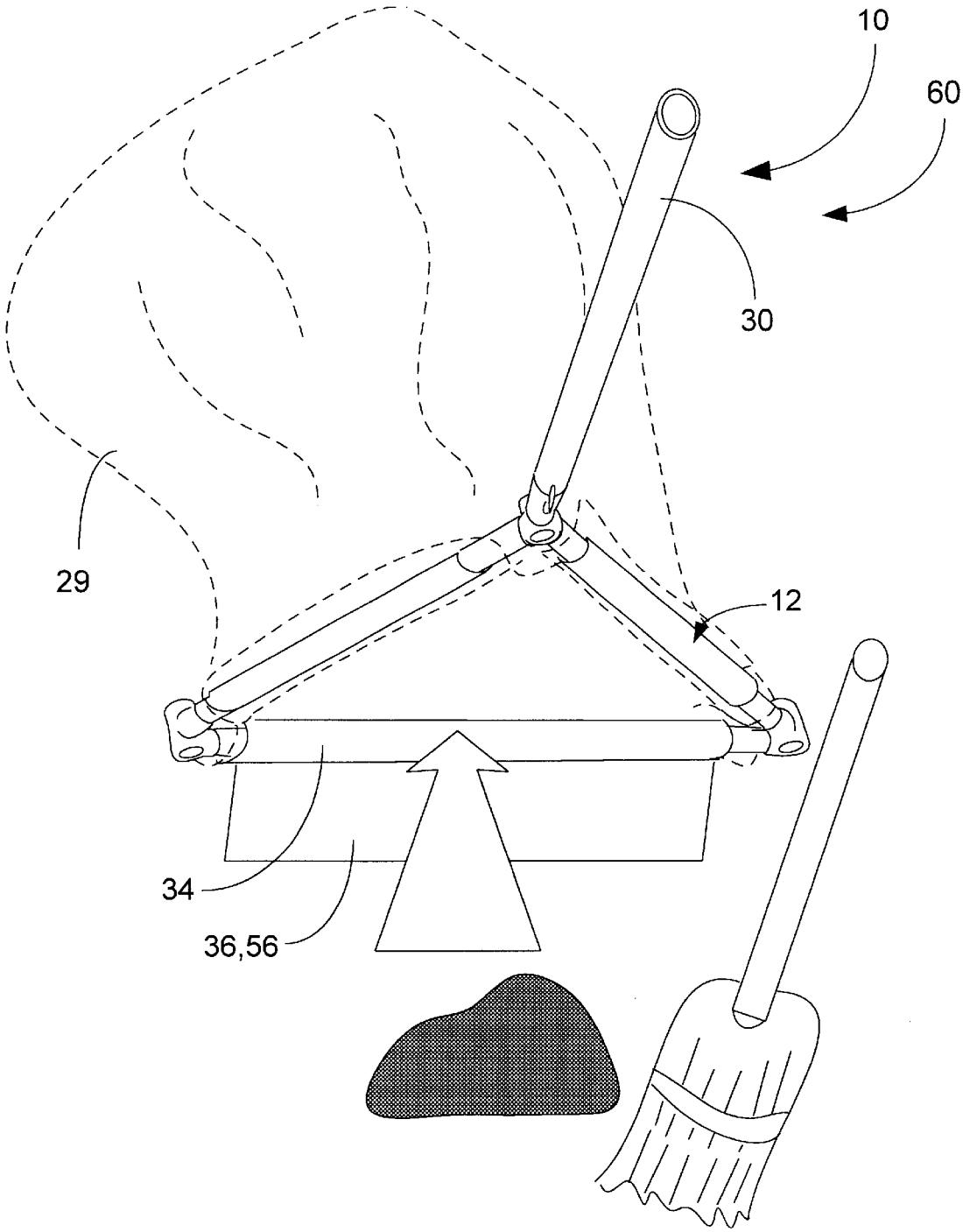
FIG. 7 illustrates a perspective view of the present invention in its collection tool configuration for sweeping with a collecting bag shown in dashed lines.

Also shown in FIG. 2 is one of the legs 28, used as a handle 30, for when the tool 10 is used in conjunction with a rake (FIG. 5) or a broom (FIG. 7). The apex connector 20 (shown in detail in FIGS. 8 and 9 preferably has an enlarged socket 38 having a central bore 40 into which the leg 28, (now handle 30) can be inserted. The inner bore 40 of the socket 38 has a diameter which is slightly larger than the outer diameter of the legs 28. One or more retaining fingers 42 may optionally be provided which are biased to press against the barrel of the handle 30. There may be optionally an indent 27 in the handle 30 barrel into which a small knob on the retaining finger 42 can engage to keep the handle 30 from slipping from the socket 38.

Many other attachment mechanisms may be used as well, as alternatives to retaining fingers and detents. Also shown in FIG. 2 is a spring biased button 33 on the lower flange 26 of a connector 8, which engages a button hole 35 when the mating parts 18, 28 are engaged. As the flange 26 enters the hollow bore 24 of the tube 28, the button 33 moves to compress an internal spring, not shown, which can be any of a number of conventional mechanisms. When the button 33 is aligned with the button hole 35, the spring pushes the button 33 into the hole 35, and helps to maintain the positioning of the parts. Of course, it will be obvious that the parts can be reversed, so that the leg 28 could have a flange 26 with button 33 that mates with a button hole 35 on the connector 18. All of the connector flanges 22, 26 may have such buttons 33, but for simplicity, not all buttons are shown here, or in the following figures, although it will be obvious that any detachable joint may have one.

It is also possible for the apex connector 20 to have a fourth flange, instead of a socket, which would be inserted into the bore 24 of the handle 30 in a similar manner to the engagement of the lower flanges with the hollow bores 24 of the legs 28. It is also possible for the handle 30 to attach to the frame 12 at some point other than at the apex connector 20. For example, one of the frame members 13 may have an attachment socket included at some point along,its length, although this is less preferred. A four sided frame could thus perhaps have an attachment socket in the center of a top-most frame member, and would be an obviously equivalent structure.

FIG. 3 illustrates the collection tool 10 used as a table frame 50 in an upright position 52 with attached support legs 28 for holding a collection bag 29, shown in dashed lines. As noted before, the ramp portion 36 of the snap ramp 34 is positioned on the inner side of the frame 12 to present an inwardly disposed entrance ramp 54. The preferred length of the legs is 30 inches, but this is of course subject to much variation, and should not be construed as a limitation.

Figure 4:
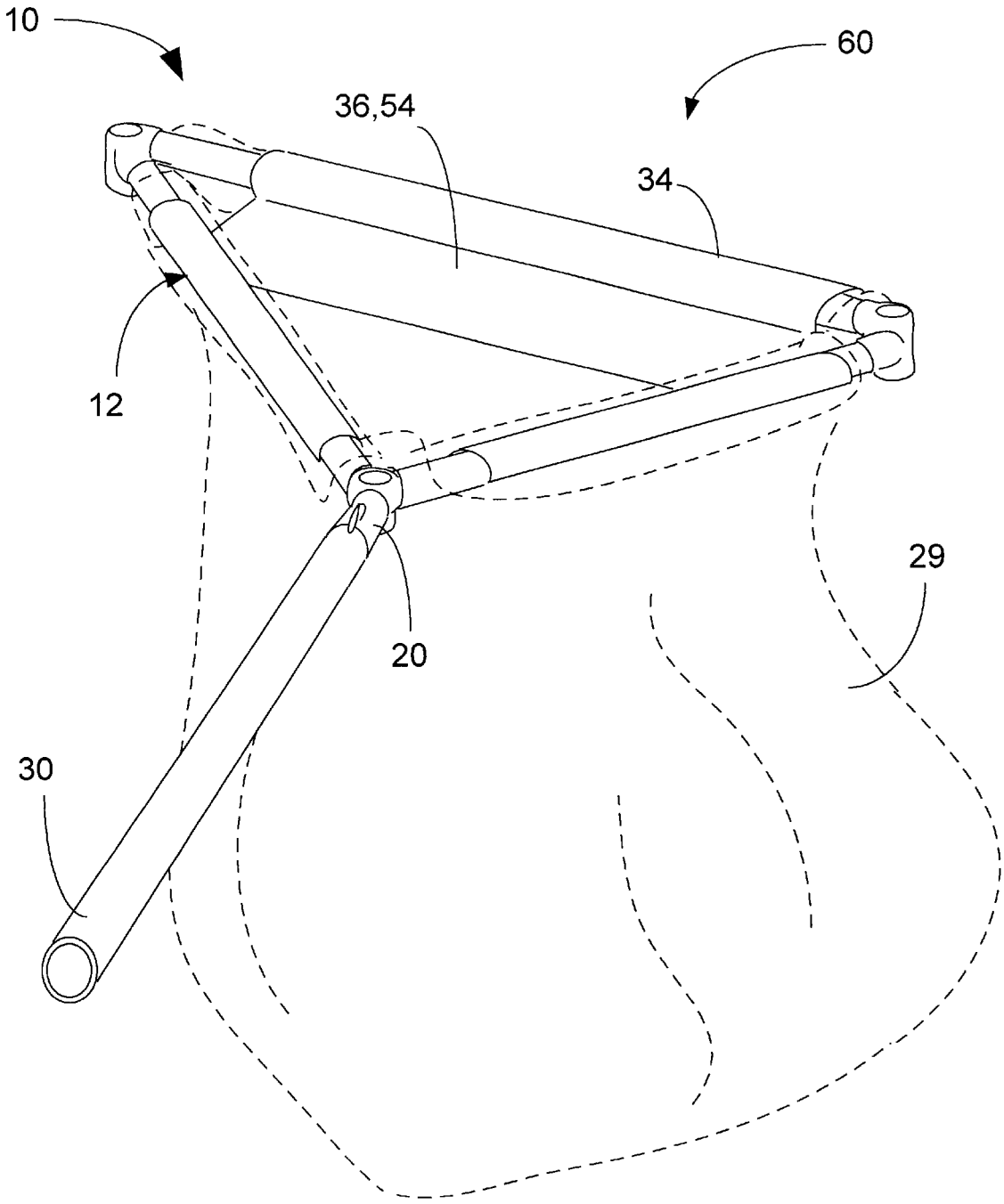
FIG. 4 shows a perspective view of the present invention in its collection tool configuration with a collecting bag shown in dashed lines.

FIG. 4 shows the collection tool 10 in handling mode 60 with handle 30 attached to frame 12 at the apex connector 20. The ramp portion 36 of the snap ramp 34 is again positioned on the inner side of the frame 12 to present an inwardly disposed entrance ramp 54. The collection bag 29 is again shown in dashed lines.

Figure 5:
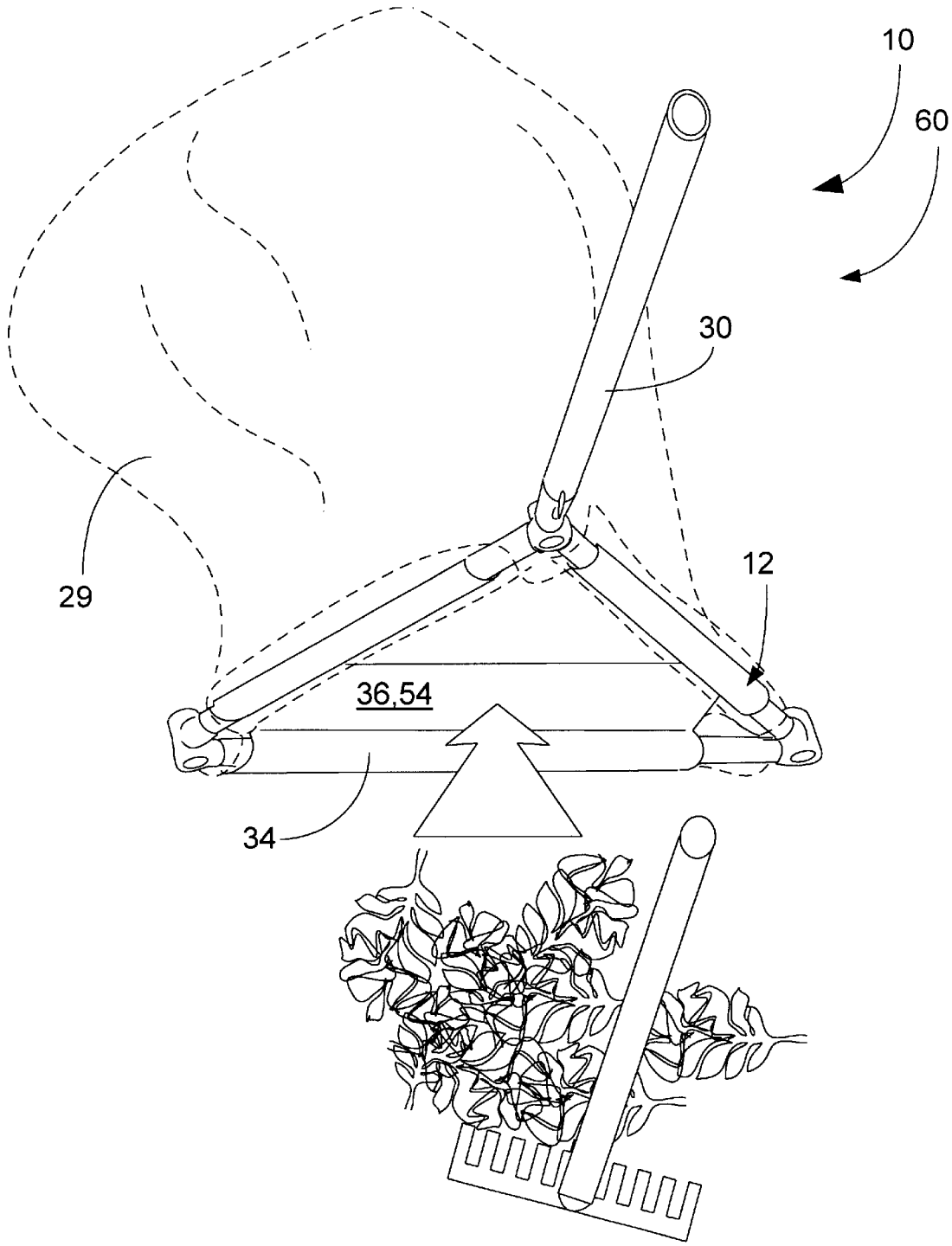
FIG. 5 shows a perspective view of the present invention in its collection tool configuration for leaf raking with a collecting bag shown in dashed lines.

FIG. 5 illustrates the collection tool 10 in handling mode 60 in preparation to use with a rake for gathering leaves. The ramp portion 36 of the snap ramp 34 is again positioned on the inner side of the frame 12 to present an inwardly disposed entrance ramp 54. The collection bag 29 is again shown in dashed lines.

Figure 6:
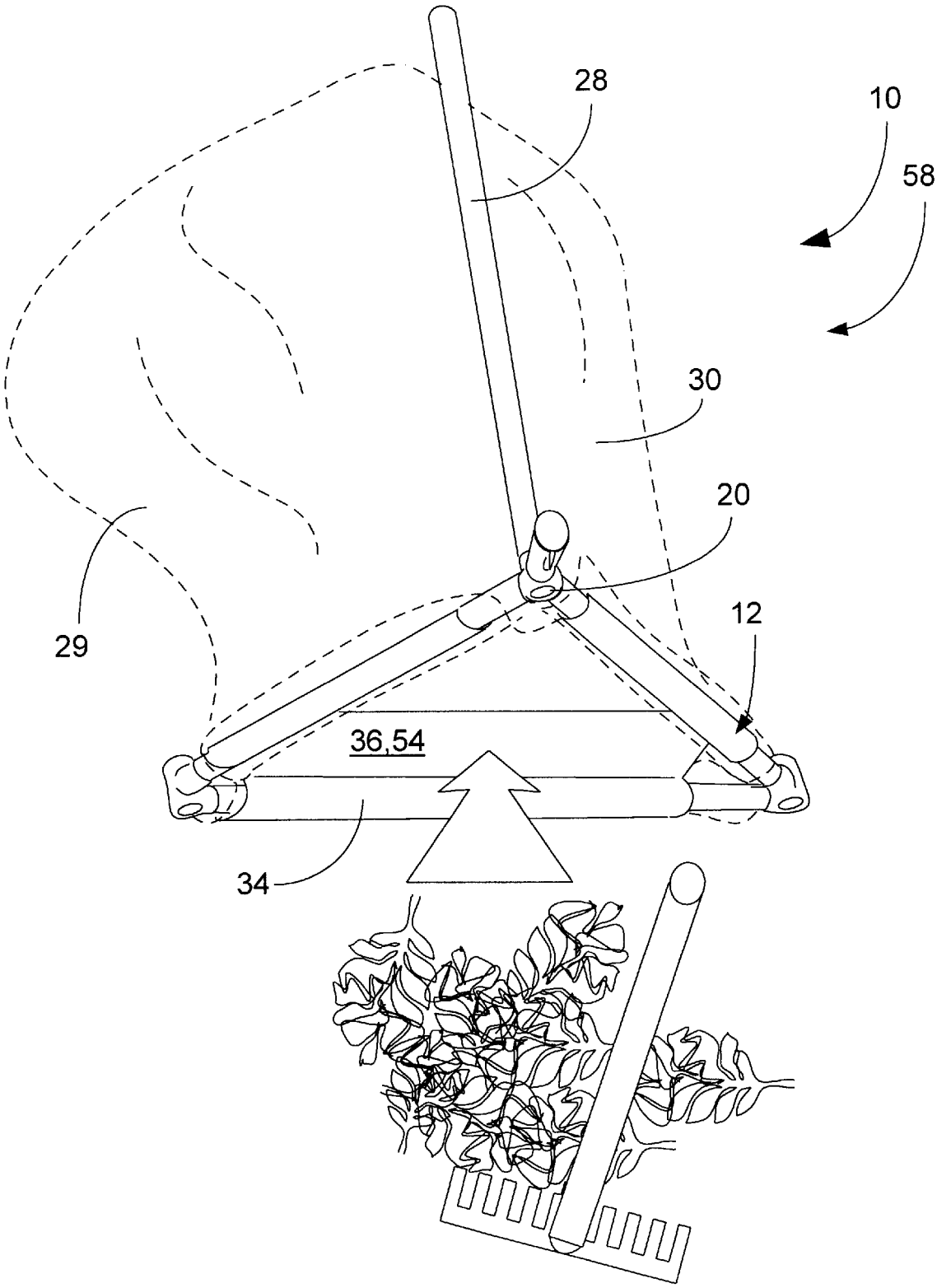
FIG. 6 illustrates a perspective view of the present invention in its freestanding reclining configuration for sweeping with a collecting bag shown in dashed lines.

FIG. 6 illustrates the collection tool 10 in another mode of operation, which will be called the free-standing position 58 in preparation to use with a rake for gathering leaves. The ramp portion 36 of the snap ramp 34 is again positioned on the inner side of the frame 12 to present an inwardly disposed entrance ramp 54. In this free-standing position 58, one of the legs 28, perhaps the one recently used as a handle 30 (see FIG. 5) has been placed in the socket of the apex connector 20. The foot of the leg 28 rests on the ground and serves to keep the mouth of the tool 10 opened and slightly reclined, so that the frame 12 is held in a convenient position for raking leaves or sweeping material into. The flat ramp portion 36 can be positioned either as an inwardly disposed entrance ramp 54 (as shown) or an outwardly disposed entrance ramp, when in this mode of operation. The collection bag 29 is again shown in dashed lines.

FIG. 7 shows the collection tool 10 in handling mode 60 in preparation to use with a broom for sweeping smaller particles of debris. The collection bag 29 is again shown in dashed lines. The ramp portion 36 of the snap ramp 34 is here positioned on the outer side of the frame 12, to act as a ramp for pushing the debris up over the width of the tubing and into the bag, thus presenting an outwardly disposed entrance ramp 56.

Figure 8:
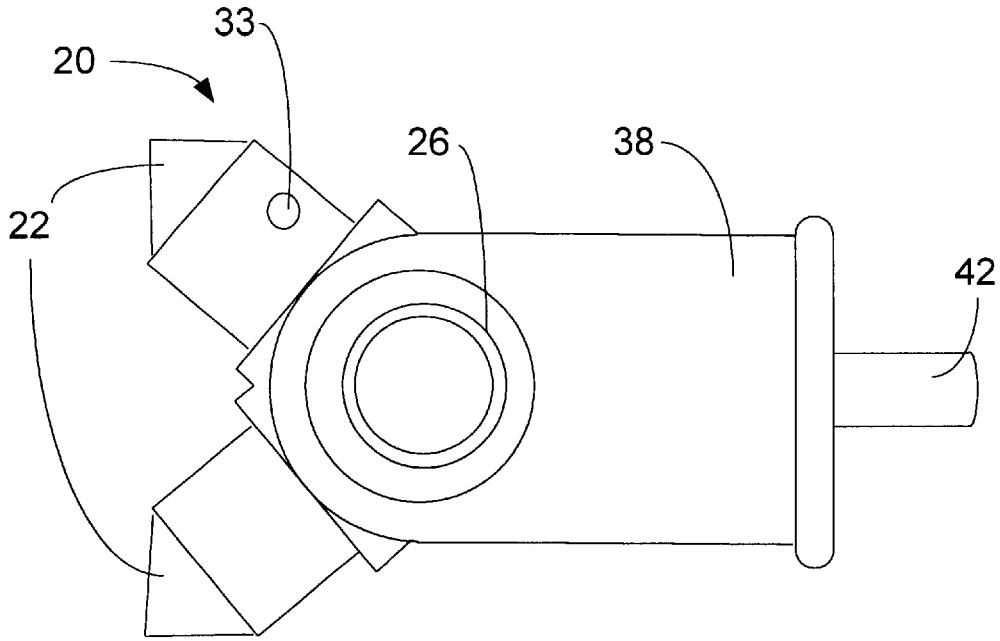
FIG. 8 shows a bottom plan view of an apex connector of the present invention.

FIG. 8 illustrates a bottom detail view of the apex connector 20 showing the flanges 22 and lower flange 26, as well as the socket 38 and retaining finger 42. It is preferred that the side flanges 22 be at an approximately 80 degree angle, but this is subject to much variation. A representative button 33 is shown, although as before, it is to be understood that any or all the flanges 22, 26 may include buttons or other retaining mechanisms.

Figure 9:
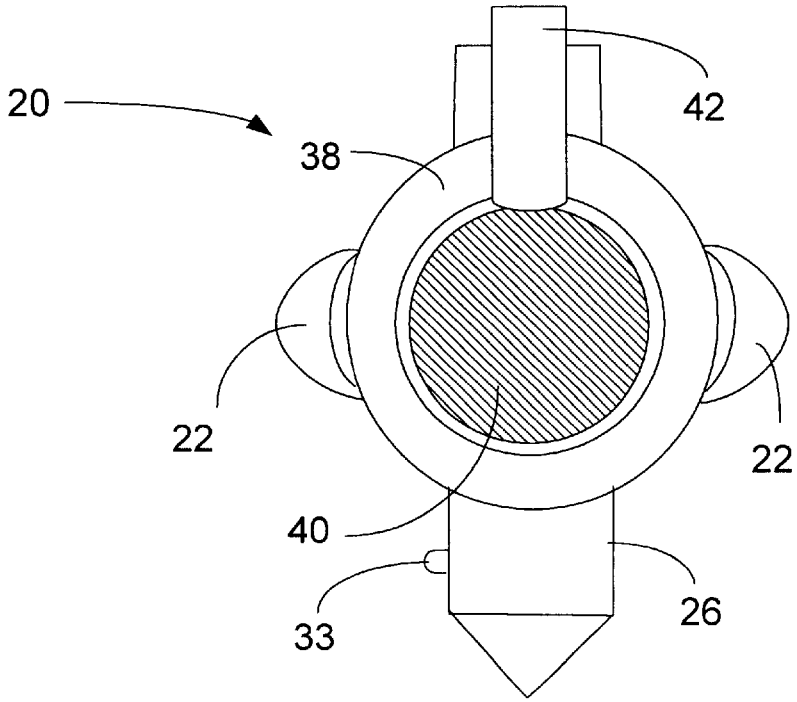
FIG. 9 illustrates a front plan view of the apex connector of FIG. 8.

FIG. 9 shows a front detail view of the apex connector 20 showing the socket 38 with its central bore 40 and retaining finger 42. The lower flange 26 and side flanges 22 can be seen as well. In this case, it is assumed that there is a single retaining finger 42 located on the opposite side from the lower flange 26, but there could also be second or third retaining fingers located on the socket 38 as well. The handle 30 which may be a leg 28, may also include a detent 27 (see FIG. 2) which is engaged by the retaining finger 42 to help maintain attachment of the handle to the frame, or as mentioned before, the socket 38 could be replaced by a fourth flange, or all flanges 22, 26 could be replaced with sockets of appropriate diameter. A representative button 33 is shown, although as before, it is to be understood that any or all the flanges 22, 26 may include buttons or other retaining mechanisms.

Figure 10:
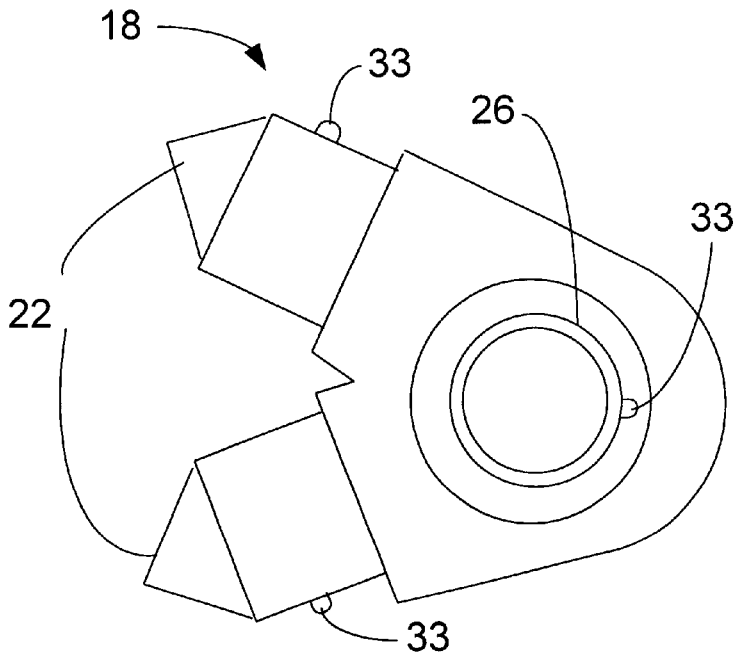
FIG. 10 shows a bottom plan view of a corner connector of the present invention.

FIG. 10 illustrates a bottom detail view of the corner connector 18 showing the flanges 22 and lower flange 26. It is preferred that the side flanges 22 be at an approximately 50 degree angle, but this is subject to much variation. Three buttons 33 are shown, although as before, it is to be understood that any or all the flanges 22, 26 may include other retaining mechanisms, or may lack buttons.

Figure 11:
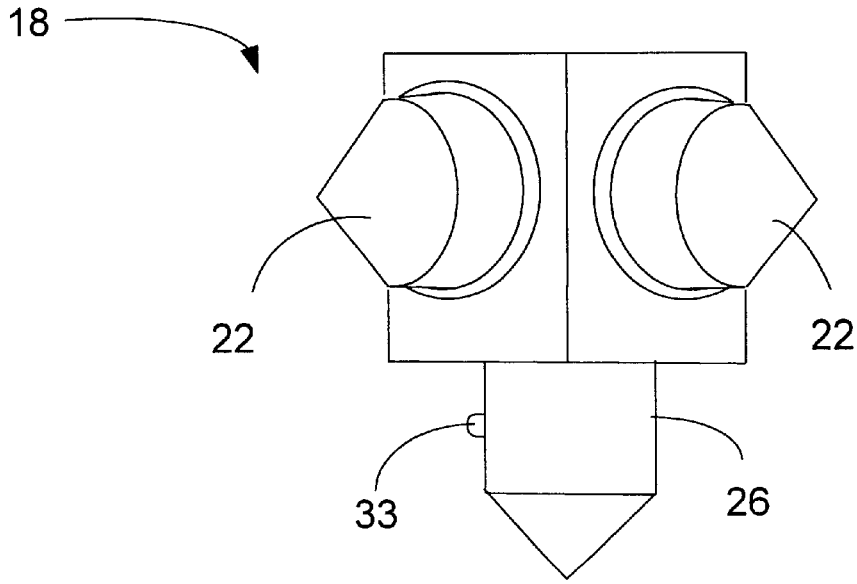
FIG. 11 illustrates a front plan view of the comer connector of FIG. 10.

FIG. 11 shows a front detail view of the comer connector 18, seen in FIG. 10, showing the lower flange 26 and side flanges 22. As mentioned before, all flanges 22, 26 could be replaced with sockets of appropriate diameter. A representative button 33 is shown, although as before, it is to be understood that any or all the flanges 22, 26 may include buttons or other retaining mechanisms.

In addition to the above mentioned examples, various other modifications and alterations of the inventive device 10 may be made without departing from the invention. While various embodiments have been described above, it should be understood that they have been presented by way of example only, and not limitation. Thus, the breadth and scope of a preferred embodiment should not be limited by any of the above described exemplary embodiments, but should be defined only in accordance with the following claims and their equivalents.

INDUSTRIAL APPLICABILITY

The present refuse bag collection tool 10 is well suited for application in collection of debris, for both home and industrial use. The refuse bag collection tool 10 can be used in any of four different ways: 1) as a support frame with attached support legs for holding a collection bag; 2) as a collection tool with a handle and an inwardly disposed entrance ramp for use in raking leaves into a collection bag; 3) as a collection tool with a handle and outwardly disposed entrance ramp for use with a broom for collecting refuse having a smaller particle size; and 4) in a free standing reclining position which supports the bag mouth wide open and in a reclining attitude for easy raking or sweeping operations.

When used as a support frame 50, the basic frame 12 is assembled by connecting ends of the side members 14 and the bottom member 16 to corner connectors 18 and apex connector 20. The side members 14 and bottom member 16 are preferably made from ½ inch steel tubing or inexpensive ¾ inch PVC pipe, thus having a hollow bore 24. The corner connectors 18 and apex connector 20 each have two tubular flanges 22 which are received by the hollow bores 24 to complete the frame 12. The corner connectors 18 and apex connector 20 each also have a lower flange 26. Three interchangeable legs 28 are provided, also preferably made from ¾ inch PVC pipe having a hollow bore 24 into which the lower flanges 26 are received, to thus construct a table frame 50 which stands upon the lower ends of the legs 28 in an upright position 52. The leg length is preferably 30 inches, so that the frame 12 stands at an appropriate height for convenient access. A refuse bag 29 is then arranged with its lip portion folded over the side and bottom members 14, 16. Snap retainers 32 are fitted into place over the bag lip, clasping the side members 14. Snap ramp 34 is also fitted in place to clasp bottom member 16, so that the bag is held with its mouth portion spread open for easily receiving debris into its interior. The snap ramp portion 36 is preferably positioned on the inner side of the frame, where it can help to funnel the flow of material into the bag, to present an inwardly disposed entrance ramp 54.

When the bag is filled, the snap retainers 32 and snap ramp 34 are removed and the bag mouth is fastened shut. The light-weight table frame 50 can then be easily lifted above the bag, and fitted with another bag, if desired.

This first mode of operation is very useful, both for home applications, and for businesses, where for examples wood shavings, or manufacturing scraps are gathered after sweeping or raking and are to be placed in bags for disposal. It is also useful for motor homes.

The second mode of use is as a collection tool with a handle and an inward disposed entrance ramp for use in raking leaves into a collection bag 29. Here, the frame 12 is assembled as before. The apex connector 20 has a socket 38 having a central bore 40 of sufficient diameter that one of the legs 28 can be inserted into it. The leg 28 thus acts as a handle 30. The snap retainers 32 are attached as before, and the snap ramp 34 is also preferably positioned with the ramp portion 36 on the inside of the frame, thus presenting an inwardly disposed entrance ramp 54.

The apex connector 20 preferably has a retaining finger 42, which helps to hold the handle 30 in the socket 38 or some other attachment mechanism such as spring biased buttons 33 and button holes 35 or merely friction fitting flanges 22, 26 which engage hollow bores 24 of the legs or vice versa. The handle 30 can then be securely manipulated to position the bag mouth in proximity to heaps of debris and leaf matter, where a rake can be employed to direct material into the bag.

The third mode of use is as a collection tool with a handle 30 and an outwardly disposed entrance ramp 56 for use with a broom for collecting refuse having a smaller particle size. The frame 12 with handle 30 is assembled, and the bag 29 is positioned. The snap retainers 32 are attached as before, and the snap ramp 34 is positioned with the ramp portion 36 on the outside of the frame 12. The handle 30 is manipulated to position the bag mouth in proximity to heaps of debris, where a broom can be employed to direct material into the bag. The outwardly disposed entrance ramp 56 now acts to aid the broom in directing debris into the bag, which might otherwise be difficult to direct over the thickness of the bottom member 16.

This mode of operation is useful in any number of operations at home or in business where sweeping substantial amounts of debris is done, such as machine shops, plant nurseries, and barber shops.

In the fourth-mode of operation, one of the legs 28, perhaps one recently used as a handle 30, is inserted into the socket of the apex connector 20. The foot of the leg 28 rests on the ground, so that the frame 12 is held in a convenient position for raking leaves or sweeping material into. The flat ramp portion 36 can be positioned either as an inwardly disposed entrance ramp 54 or an outwardly disposed entrance ramp 56, when in this mode of operation.

It is to be understood that the triangular configuration described herein, and the preferred dimensions of the members are by no means to be considered as limitations. The present invention 10 can be practiced with many different configurations of sides and sizes of sides. There may be frames 12 which are designed specifically for certain applications or to fit in certain sized passageways. It is also possible that the members 14, 16 of the frame 12 could be made intentionally "customizable" so that a user could cut them to length to fit a certain sized bag or to fit a certain sized area, for example, behind a certain piece of production machinery on a shop floor.

For the above, and other, reasons, it is expected that the refuse collection bag tool 10 of the present invention will have widespread industrial applicability. Therefore, it is expected that the commercial utility of the present invention will be extensive and long lasting.

What is claimed is:

1. A collecting tool for use with a refuse collection bag, comprising:

a frame including a plurality of frame members which are joined by connectors;

a plurality of retainers for attaching a refuse collection bag to said frame;

a handle which is detachably attachable to said frame, so that said frame and attached bag can be manipulated during refuse collection; and a plurality of legs which are detachably attachable to said frame, said legs acting to support said frame and an attached refuse collection bag in an upright position, and which are removable during refuse collection or storage.

2. The collecting tool of claim 1, wherein:

said connectors include corner connectors and at least one apex connector.

3. The collecting tool of claim 2, wherein:

said handle attaches to said apex connector.

4. The collecting tool of claim 1, wherein:

said frame members include side members and a bottom member.

5. The collecting tool of claim 1, wherein:

said retainers attach to said frame members.

6. The collecting tool of claim 1, wherein:

said retainers are snap retainers.

7. The collecting tool of claim 6, wherein:

one of said snap retainers is a snap ramp, including a flat ramp portion.

8. The collecting tool of claim 7, wherein:

said snap ramp is reversible in direction so that said flat ramp portion may serve as an inwardly disposed entrance ramp, or as an outwardly disposed entrance ramp.

9. The collecting tool of claim 1, wherein:

one of said legs when detached can be reattached to serve as said handle.

10. The collecting tool of claim 1, wherein:

said connectors include attachment mechanisms which maintain connection between connectors, frame members, legs and handle, said attachment mechanisms chosen from the group consisting of retaining fingers and detents, buttons and button holes, and flanges and sockets.

11. The collecting tool of claim 1, wherein:

said frame of said tool can be configured in a free-standing position by attachment of at least one of said legs to one of said connectors.

12. A tool for use with a refuse collection bag, comprising:

a frame including a plurality of frame members, which are joined by connectors;

a plurality of retainers for attaching a refuse collection bag to said frame; and a plurality of legs which are detachably attachable to said frame, said legs acting to support said frame and an attached refuse collection bag in an upright position and wherein one of said legs when detached can be reattached to said frame to serve as a handle, to manipulate said tool during refuse collection.

13. The tool of claim 12, wherein:

one of said retainers is a snap ramp, including a flat ramp portion which is reversible in direction so that said flat ramp portion may serve as an inwardly disposed entrance ramp, or as an outwardly disposed entrance ramp.

14. A method of supporting a refuse collection bag in both an upright position and a handling mode by use of a convertible refuse collecting tool, comprising:

A) assembling a frame from frame members which include side members and at least one bottom member, and connectors;

B) attaching a refuse bag to said frame by use of a plurality of retainers;

C) attaching a detachable handle to said frame to configure said tool in a handling mode; and D) attaching a plurality of legs to said frame to configure said tool and the attached bag in an upright position.

15. The method of claim 14, wherein:

said detachable handle of step C serves as one of said plurality of legs in step D.

16. The method of claim 14, wherein:

one of said plurality of retainers of step B is a snap ramp, including a flat ramp portion which is reversible in direction so that said flat ramp portion may serve as an inwardly disposed entrance ramp, or as an outwardly disposed entrance ramp.

17. A convertible refuse collecting tool for collecting refuse comprising:

a frame including a plurality of frame members, including side members an a bottom member, which are joined by connectors including corner connectors and at least one apex connector;

a plurality of retainers for attaching a refuse collection bag to said frame, where one of said retainers is a snap ramp, including a flat ramp portion which is reversible in direction so that said flat ramp portion may serve as an inwardly disposed entrance ramp, or as an outwardly disposed entrance ramp; and a plurality of legs which are detachably attachable to said frame, said legs acting to support said frame and an attached refuse collection bag in an upright position and wherein one of said legs when detached can be reattached to said frame to serve as a handle, to manipulate said tool during refuse collection.

18. The convertible refuse collecting tool of claim 17, wherein:

said handle attaches to said apex connector, and said apex connector includes at least one retaining finger which engages a portion of said handle to maintain connection with said apex connector.

19. A collecting tool for use with a refuse collection bag, which is convertible from an upright position to a handling mode configuration, said collecting tool comprising:

a frame including a plurality of frame members which are joined by connectors;

a plurality of retainers for attaching a refuse collection bag to said frame;

a plurality of legs which are detachably attachable to said frame, said legs acting to support said frame and an attached refuse collection bag when said tool is used in said upright position, and which are detached when in said handling mode configuration; and one of said plurality of legs when detached is reattached to said frame when used in said handling mode configuration to serve as a handle.

20. The collecting tool of claim 19, wherein:

said connectors include an apex connector; and said collecting tool is further convertible to a free standing position by attachment of one of said legs to said apex connector.

21. The collecting tool of claim 20, wherein:

said handle is attached to said apex connector when collecting tool is converted to said handling mode; and said plurality of frame members includes a bottom member which is substantially straight and which is positioned opposing said apex connector in said frame, said bottom member being positioned nearest the ground of all the frame members when said collecting tool is converted to said handling mode.

* * * * *